US012173579B2

(12) United States Patent
Barajas et al.

(10) Patent No.: US 12,173,579 B2
(45) Date of Patent: Dec. 24, 2024

(54) MULTI-INTERFACE MECHANICAL SEALING SYSTEM AND METHOD

(71) Applicant: Baker Hughes Oilfield Operations LLC, Houston, TX (US)

(72) Inventors: Diego Barajas, Querétaro (MX); Melvin Medina, Spring, TX (US); Jose Humberto Hernandez, Querétaro (MX); Juan Pablo Herrera, Querétaro (MX); Wei He, Katy, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 178 days.

(21) Appl. No.: 17/935,485

(22) Filed: Sep. 26, 2022

(65) Prior Publication Data

US 2024/0102353 A1 Mar. 28, 2024

(51) Int. Cl.
*E21B 33/04* (2006.01)
*E21B 33/12* (2006.01)

(52) U.S. Cl.
CPC ..... *E21B 33/1212* (2013.01); *E21B 33/04* (2013.01)

(58) Field of Classification Search
CPC ..... E21B 33/04; E21B 33/1212
See application file for complete search history.

(56) References Cited

U.S. PATENT DOCUMENTS 4,353,560 A 10/1982 Tohill
4,556,224 A 12/1985 Le
4,595,053 A 6/1986 Watkins
4,650,226 A 3/1987 Babbitt
4,718,679 A 1/1988 Vyvial
RE34,071 E * 9/1992 Van Bilderbeek ..... E21B 33/04 166/368
5,524,710 A * 6/1996 Shinn ..... E21B 33/04 166/88.4
8,205,890 B2 6/2012 Sundararajan
8,960,276 B2 2/2015 Lang
2009/0266558 A1 10/2009 Farquharson et al.
2013/0014947 A1* 1/2013 Wilkins ..... E21B 43/26 166/281

(Continued)

OTHER PUBLICATIONS

H.D. Henderson et al., "Field performance of a newly developed 15,000-psi W.P. subsea wellhead," May 7, 1984, Offshore Technology Conference Houston, Texas, abstract only, 2 pages.

(Continued)

*Primary Examiner* — Giovanna Wright
(74) *Attorney, Agent, or Firm* — Bake Hughes Patent Organization

(57) ABSTRACT

A wellbore system includes an upper head and a lower head coupled to the upper head by one or more fasteners. The wellbore system also includes a seal ring positioned within a seal pocket to engage the upper head to form a first seal interface between the upper head and the seal ring. The wellbore system includes a hanger arranged within a bore. The wellbore system includes a packoff positioned between the hanger and the lower head. The wellbore system includes one or more lock screws to apply a downward force to the packoff to establish a second seal interface between the packoff and the seal ring and a third seal interface between the packoff and the hanger.

18 Claims, 7 Drawing Sheets

(56) References Cited

U.S. PATENT DOCUMENTS

| | | | | |
|---|---|---|---|---|
| 2014/0151024 | A1* | 6/2014 | Sinnott | E21B 33/04 166/115 |
| 2017/0198540 | A1 | 7/2017 | Chirko et al. | |
| 2019/0093439 | A1 | 3/2019 | Kauffmann et al. | |

OTHER PUBLICATIONS

J. Milberger et al., "High-Performance Metal-seal System for Subsea Wellhead Equipment," May 1, 1989, Offshore Technology Conference Houston, Texas, abstract only, 2 pages.

International Search Report and Written Opinion issued in PCT Application No. PCT/US2023/074776, dated Jan. 2, 2024.

* cited by examiner

MULTI-INTERFACE MECHANICAL SEALING SYSTEM AND METHOD

BACKGROUND

1. Field of the Disclosure

The present disclosure relates to a system and method for wellbore operations. Specifically, the present disclosure relates to a multi-interface sealing system that uses mechanical forces to set seals at different interfaces.

2. Description of Related Art

Oil and gas exploration, drilling, and production may include positioning various tubulars within a wellbore to different stages of operations. The tubulars may be part of various downhole systems, such as drilling systems, completion systems, and the like. In these systems, hangers may suspend or otherwise support a tubular that extends into the wellbore. Often, components of these hanger systems include metal-to-metal sealing interfaces in order to restrict high downhole pressures. The metal-to-metal seals may be set with high setting forces, which may be facilitated by the use of hydraulic tools. These hydraulic tools may be expensive to deploy, time consuming to use, and necessitate additional equipment at the well site.

SUMMARY

Applicant recognized the limitations with existing systems herein and conceived and developed embodiments of systems and methods, according to the present disclosure, for improved tool configurations for wellhead sealing systems.

In an embodiment, a wellbore system includes an upper head and a lower head coupled to the upper head by one or more fasteners, the one or more fasteners arranged axially along a bore extending through the upper head and the lower head. The wellbore system also includes a seal ring positioned within a seal pocket formed in the upper head and the lower head, the seal ring positioned to engage the upper head to form a first seal interface between the upper head and the seal ring. The wellbore system further includes a hanger arranged within the bore. The wellbore system includes a packoff positioned between the hanger and the lower head. The wellbore system also includes one or more lock screws to extend through the lower head and engage the packoff, the one or more lock screws to apply a downward force to the packoff to establish a second seal interface between the packoff and the seal ring and a third seal interface between the packoff and the hanger.

In an embodiment, a sealing assembly includes a seal ring to be positioned within a seal pocket of a wellhead system. The sealing assembly also includes a packoff to be positioned within a first bore of the wellhead system, the packoff to be radially inward of the seal ring. The sealing assembly further includes a hanger to be positioned within a second bore of the packoff, the hanger to be radially inward of the seal ring. The packer is configured to move in a downward direction responsive to an external mechanical force to form a first metal-to-metal seal between the seal ring and the packoff and to form a second metal-to-metal seal between the packoff and the hanger.

In an embodiment, a method includes providing a wellhead assembly including a seal ring, wherein a first seal interface is formed between the seal ring and a component of the wellhead assembly. The method also includes installing the wellhead assembly at a well site. The method further includes landing a hanger and a packoff within a bore of the wellhead assembly. The method also includes activating one or more lock screws to engage the packoff.

BRIEF DESCRIPTION OF DRAWINGS

The present technology will be better understood on reading the following detailed description of non-limiting embodiments thereof, and on examining the accompanying drawings, in which.

DETAILED DESCRIPTION

Figure 1:
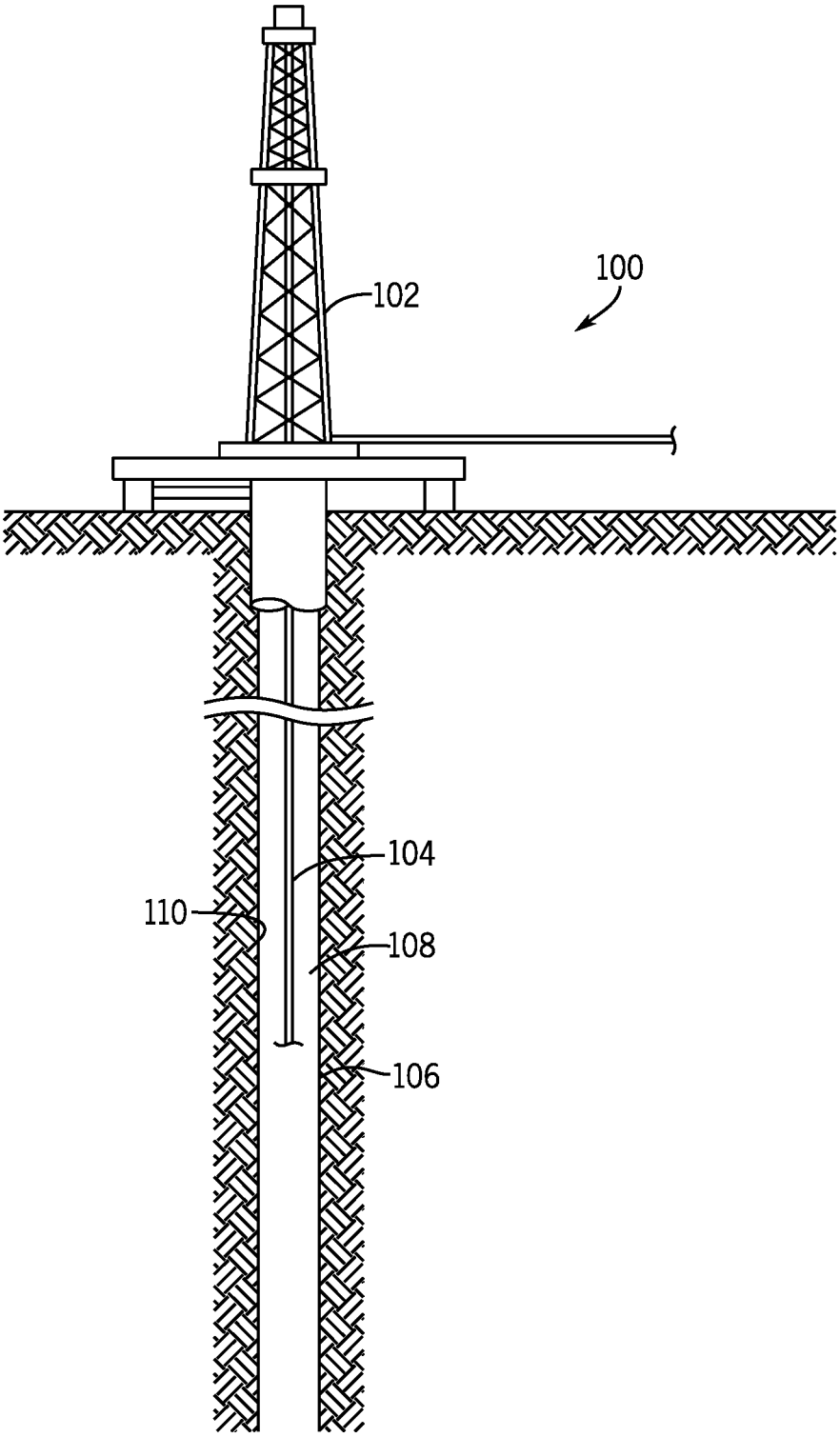
FIG. 1 is a cross-sectional side view of an embodiment of a wellbore system, in accordance with embodiments of the present disclosure.

The foregoing aspects, features, and advantages of the present disclosure will be further appreciated when considered with reference to the following description of embodiments and accompanying drawings. In describing the embodiments of the disclosure illustrated in the appended drawings, specific terminology will be used for the sake of clarity. However, the disclosure is not intended to be limited to the specific terms used, and it is to be understood that each specific term includes equivalents that operate in a similar manner to accomplish a similar purpose. Additionally, references numerals may be reused for similar features between figures, however, such use is not intended to be limiting and is for convenience and illustrative purposes only.

When introducing elements of various embodiments of the present disclosure, the articles "a", "an", "the", and "said" are intended to mean that there are one or more of the elements. The terms "comprising", "including", and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments", or "other embodiments" of the present disclosure are not intended to be interpreted as excluding the existence of additional embodiments that also incorporate the recited features. Furthermore, reference to terms such as "above", "below", "upper", "lower", "side", "front", "back", or other terms regarding orientation or direction are made with reference to the illustrated embodiments and are not intended to be limiting or exclude other orientations or directions.

Embodiments of the present disclosure are directed toward a wellhead sealing system, such as a multi-bowl hanger system, that uses one or more mechanical systems to set seals at various sealing interfaces. Various embodiments enable setting of sealing interfaces without the assistance of a hydraulic system, thereby reducing costs and complexity at the wellsite. In at least one embodiment, lock screws are used to set one or more metal-to-metal seals within a wellhead sealing system. Furthermore, additional metal-to-metal seals may be set using additional mechanical fasteners between components used within the system. Accordingly, various embodiments reduce or eliminate the use of hydraulic tools for setting seals.

In at least one embodiment, a multi-bowl wellhead system includes a hanger suspended within a lower head. The lower head is coupled to an upper head, and a seal ring (e.g., packoff ring) is arranged within a bore of the lower head and the upper head, with the seal ring having a metal-to-metal sealing interface with both the upper head and the lower head. Furthermore, embodiments may include a packoff positioned between the lower head and a hanger, such as a tubing or casing hanger. The packoff and seal ring may have a metal-to-metal seal at an interface. Additionally, a metal-to-metal seal may be formed between the packoff and the hanger. These metal-to-metal seals may be set, at least in part, due to engagement of the packoff via lock screws. The lock screws may apply a force that drives the packoff in an axially downward (e.g., into the wellbore) direction. This downward force may drive interaction at one or more sloped or tapered surfaces, which may convert at least a portion of the downward force in a radially inward or outward force, thereby providing a crush force between metal-to-metal sealing surfaces. Various embodiments provide a wellhead sealing system that include a bowl assembly having the upper head, lower head, and seal ring as a common configuration. Additionally embodiments may provide the packoff and the hanger, which may be provided separately or as a kit or assembly, for use with downhole wellbore operations.

It should be appreciated that various embodiments may be used in surface drilling, completion, and/or recovery operations. Additionally, embodiments may be used in subsea applications. Moreover, various components and dimensions may be adjusted to accommodate different pressures or wellbore configurations. For example, one or more components may be substituted for higher pressure applications.

FIG. 1 is a schematic side view of an embodiment of a wellbore system 100, which may include a completion system, a recovery system, or a drilling system. In this example, the wellbore system 100 a rig 102 and a string 104 coupled to the rig 102. The string 104 may extend through a wellhead assembly (not pictured) such as a blowout preventer (BOP) and/or one or more valve configurations. The wellhead assembly may be a surface assembly, which is not visible in the illustrated embodiment due to a platform of the rig 102, but it should be appreciated that it may be provided in various embodiments. Systems and methods may be utilized in embodiments where one or more completion or recovery operations are initiated, such as when the string 104 is suspended into a wellbore 106. In this example, the string 104 may be a completion or production string, which may include one or more tubulars coupled together and suspended from one or more features, such as the wellhead assembly and/or a casing/tubing hanger, among other options. It should be appreciated that the string 104 may also be a casing string, where one or more cementing operations may be used to cement and secure the string 104 to a wellbore wall.

In this example, the string 104 is suspended into an annulus 108 formed between the string 104 and a wellbore wall 110. The string 104, as noted above, may be secured to one or more assembly that are configured to receive and support the string 104, such as a hanger assembly. In operation, the hanger assembly may be arranged within the wellbore 106, or at a surface location, and may include one or more seals to control pressure within the wellbore.

Figure 2:
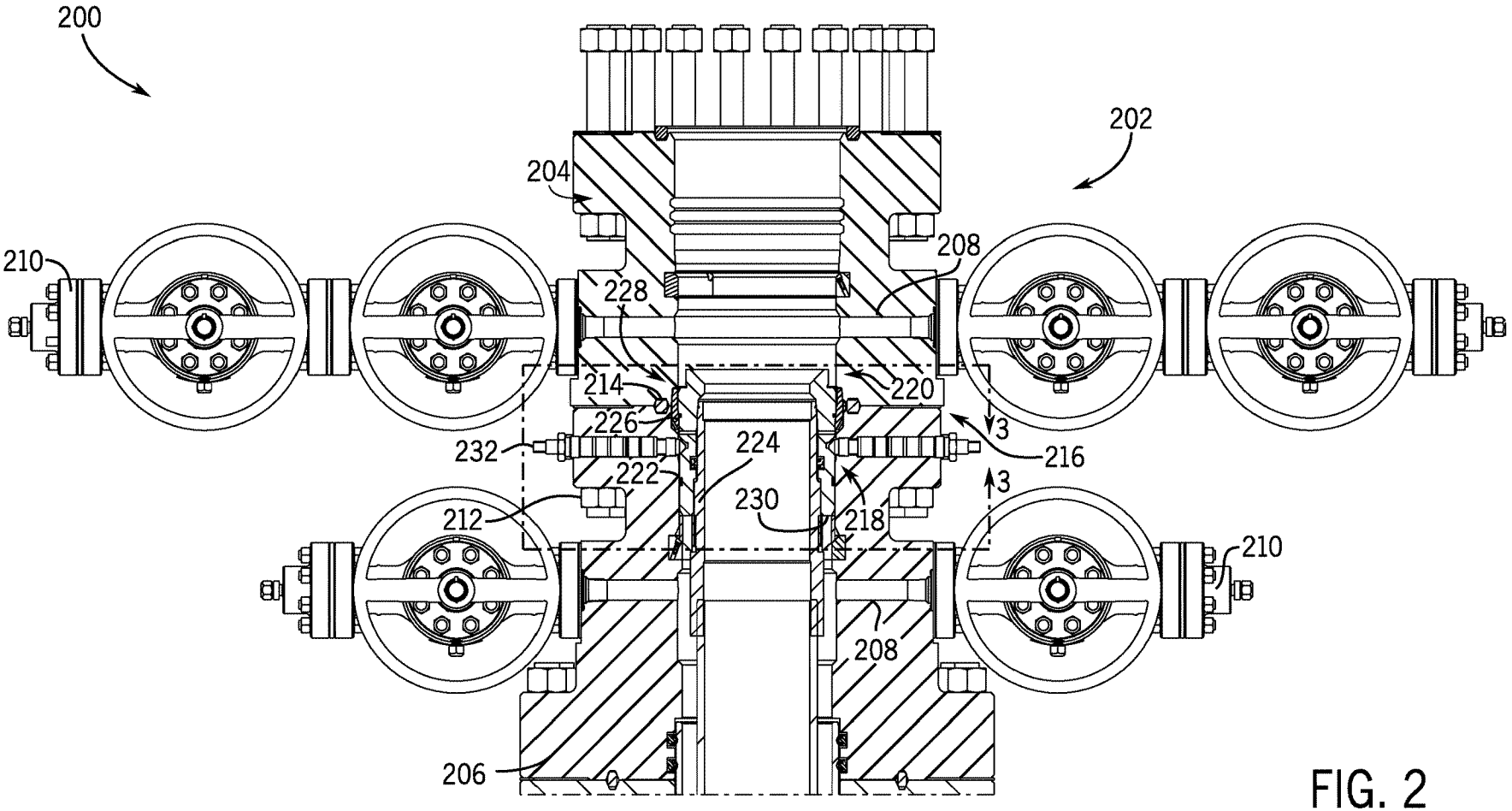
FIG. 2 is a cross-sectional side view of an embodiment of a wellhead system, in accordance with embodiments of the present disclosure.

FIG. 2 is a schematic cross-sectional view of an embodiment of a wellhead system 200 that may form a portion of the wellbore system 100. In this example, the wellhead system 200 may be a surface system that is coupled to one or more surface components, such as a wellhead. Furthermore, embodiments may include additional features, such as a BOP, additional hangers, and the like. The illustrated embodiment includes a multi-bowl system 202 having an upper head 204 and a lower head 206. Further illustrated are ports 208 and valves 210 extending from both the upper head 204 and the lower head 206. The upper head 204 and lower head 206 are coupled together via one or more fasteners 212 and include a ring joint 214 between a coupling interface 216. It should be appreciated that the illustrated configuration is but one example of the multi-bowl system 202 and various other embodiments may include one or more alternative arrangements, such as more or fewer valves, additional ports, different coupling arrangements, and the like.

In this example, a sealing assembly 218 is positioned within a bore 220 of the multi-bowl system 202, where the sealing assembly 218 extends across the interface 216 in the illustrated embodiment. The illustrated sealing assembly 218 includes a packoff 222 and a hanger 224. Furthermore, a seal ring 226 (e.g., packoff ring) is arranged at the interface 216, but it should be appreciated that the seal ring 226 may be considered as part of the multi-bowl system 202 in certain embodiments. That is, the seal ring 226 may be installed and secured between the upper head 204 and the lower head 206 prior to shipment and installation. However, in various embodiments, the seal ring 226 is a separate component and/or may be considered a portion of the sealing assembly 218.

In the illustrated embodiment, the seal ring 226 is positioned against an inner diameter of both the upper head 204 and the lower head 206, for example within a seal pocket or recess 228. The packoff 222 sits radially inward of the seal ring 226 and the hanger 224 is radially inward of the packoff 222. In this example, the packoff 222 is landed on a shoulder 230. Upon activation, the sealing assembly 218 may secure the hanger 224 within the multi-bowl system 202 to permit a tubular to be suspended from the hanger 224 for various wellbore operations.

Embodiments of the present disclosure may eliminate or reduce use of various hydraulic systems by using lock screws 232 to set the packoff 222, which may be used to set one or more metal-to-metal sealing interfaces, as will be described below. Use of the lock screws 232 may be considered a mechanical seal activation, as opposed to one that uses hydraulic pressure. The use of mechanical seal action may reduce costs at the well site by eliminating or reducing use of high pressure hydraulic tools, which may not only be expensive to use, but also time consuming to mobile and set up at the well site.

In operation, the multi-bowl system 202 may be provided to a well site. The multi-bowl system 202 may be arranged such that the seal ring 226 is positioned within the seal pocket 228 and a metal-to-metal seal may be formed between the seal ring 226 and at least one of the upper head 204 and/or the lower head 206, as will be described below. The metal-to-metal seal may be energized due to mechanical forces due to the coupling at the interface 216 via the fasteners 212. Thereafter, the hanger 224 and packoff 222 may be landed and activation of the lock screws 232 may drive different metal-to-metal sealing interfaces together, thereby preparing the hanger 224 for use with various wellbore operations. The hanger 224 and packoff 222 may be removed, if necessary, by releasing the lock screws 232. Additionally, the seal ring 226 may also be removed, if necessary, for various contingencies.

Figure 3:
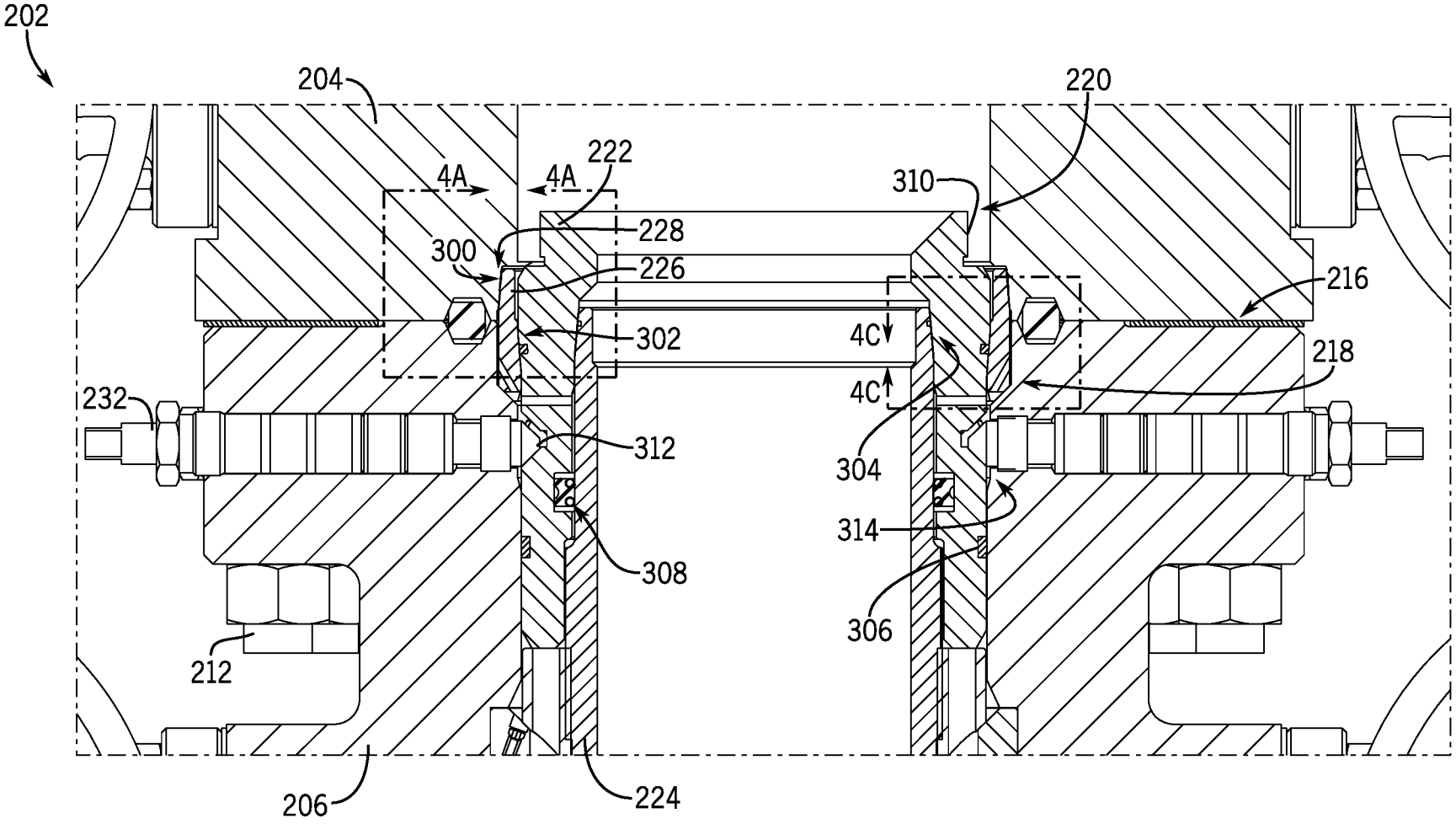
FIG. 3 is a cross-sectional side view of an embodiment of a sealing assembly within a wellhead system, in accordance with embodiments of the present disclosure.

FIG. 3 is a schematic cross-sectional view of the multi-bowl system 202 in which the sealing assembly 218 is in an activated position such that three metal-to-metal seals are shown. A first metal-to-metal seal is present between the seal ring 226 and the upper head 204. A second metal-to-metal seal is present between the seal ring 226 and the packoff 222. A third metal-to-metal seal is present between the packoff 222 and the hanger 224. Each of these seals is formed, at least in part, due to a mechanical force applied to one or more components of the system. For example, the seal ring 226 may be energized against the upper head 204 via the fasteners 212. The packoff 222 may be energized via the lock screws 232, which may apply a force that drives the packoff 222 in a downward direction (e.g., into the wellbore, away from the upper head 204) such that at least a portion of the force is converted to a radial force due to different sloped or taper interfaces presented within the system. In this manner, use of a hydraulic setting tool may be eliminated or reduced.

The illustrated embodiment includes both the packoff 222 and the hanger 224 extending across the coupling interface 216 of the upper head 204 and the lower head 206. It should be appreciated that this configuration is for illustrative purposes and that other embodiments may limit a position of one or more of the packoff 222 and/or the hanger 224. The seal ring 226 is positioned within the seal pocket 228 such and may form at least a portion of the bore 220. In operation, the seal ring 226 may be positioned within the seal pocket 228 and at least partially activated prior to installation at the well site. That is, the multi-bowl system 202 may be shipped where the upper head 204 is coupled to the lower head 206 and the seal ring 226 is positioned within the seal pocket 228 such that the fasteners 212 have activated the metal-to-metal seal between the seal ring 226 and the upper head 204.

A first seal interface 300 corresponds to the metal-to-metal seal formed between the seal ring 226 and the upper head 204. As will be shown below, one or more sloped sealing surfaces may be utilized to form the metal-to-metal seal, where a sufficient force may lead to a crush between the surfaces, thereby providing a sealed connection to block pressure above and/or below the seal. In various embodiments, the surfaces may be prepared for such a seal, for example, by polishing or otherwise undergoing one or more surface preparation activities. Additionally, in at least one embodiment, one or more sealing features may be present on one or more of the surfaces, as will be described in more information below.

A second seal interface 302 corresponds to the metal-to-metal seal formed between the seal ring 226 and the packoff 222. As will be shown below, one or more sloped or tapered surfaces may facilitate formation of the seal between the respective surfaces. For example, when a downward force is applied to the packoff 222, via the lock screws 232, movement of the packoff 222 may be translated to a sloped surface that causes a crush at a seal surface location, thereby forming the metal-to-metal seal. Additional seals may also be provided, as noted above, and moreover, various operations may be used to form sealing surface having predetermined conditions, such as a roughness.

A third seal interface 304 corresponds to the metal-to-metal seal formed between the packoff 222 and the hanger 224. As will be shown below, one or more sloped or tapered surfaces may facilitate formation of the seal between the respective surfaces. For example, when a downward force is applied to the packoff 222, via the lock screws 232, movement of the packoff 222 may be translated to a sloped surface that causes a crush at a seal surface location, thereby forming the metal-to-metal seal. Additional seals may also be provided, as noted above, and moreover, various operations may be used to form sealing surface having predetermined conditions, such as a roughness.

In this example, the packoff 222 is shown extending through the bore 220 such that an outer packoff seal 306 engages the lower head 206. This outer packoff seal 306 may be an elastomer seal, as an example, but it should be appreciated that other seals may be used. The outer packoff seal 306 may be used to provide additional sealing capabilities, but it should be appreciated that the outer packoff seal 306 may be eliminated in one or more embodiments. The packoff 222 also includes an inner seal 308 which engages the hanger 224. This inner packoff seal 308 may be an elastomer seal, as an example, but it should be appreciated that other seals may be used. The inner packoff seal 308 may be used to provide additional sealing capabilities, but it should be appreciated that the packoff seal 308 may be eliminated in one or more embodiments. The packoff 222 may also include one or more hanger features that secure the hanger 224 within the packoff 222. For example, the hanger 224 is shown positioned within a bore of the packoff 222 and may be secured via the features, for example at a reduced diameter portion of the hanger 224. The packoff 222 may also include engagement features 310, such as threads, to interact with a tool for running the packoff 222. For example, the tool may thread to the engagement features 310 to run the packoff 222 to land on the shoulder 230. Upon landing, there may be a gap or other space that is closed upon activation via the lock screws 232.

The illustrated lock screws 232 as shown extending radially through the lower head 206. The lock screws 232 may include one or more threads that allow the lock screws 232 to advance toward the bore 220 in a measured or predetermined way. For example, there may be a plurality of lock screws 232 positioned circumferentially about the lower head 206. When activated, the lock screws 232 may be torqued or otherwise driven toward the bore 220 in a predetermined pattern, such as a pattern where a first lock screw is driven a predetermined distance and then an opposite (e.g., a lock screw offset by 180 degrees) is driven toward the bore 220. In this manner, a specific pattern may be observed in order to activate the seals, which may reduce a likelihood of error or incomplete sealing.

The lock screws 232 include a tapered tip 312 that engages a tapered receptacle 314 formed in the packoff 222. The respective tapered surfaces of the tips 312 and the receptacle 314 may convert at least a portion of the radial force of the lock screws 232 into a downward force. This downward force may then drive the packoff 222 in the downward direction, thereby applying a mechanical force to set various seals within the system.

Figure 4A:
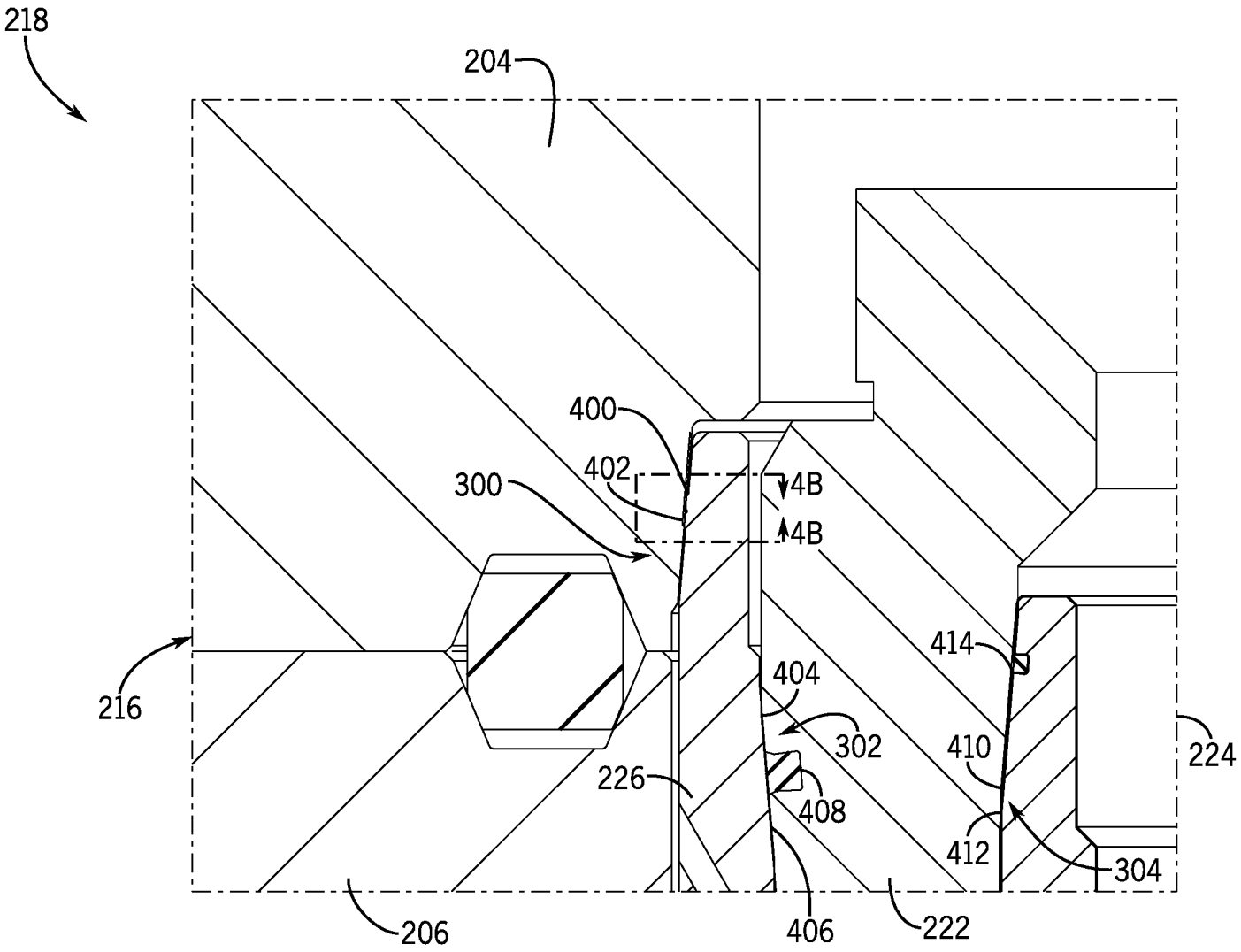
FIG. 4A is a partial cross-sectional side view of an embodiment of a sealing assembly within a wellhead system, in accordance with embodiments of the present disclosure.
Figure 4B:
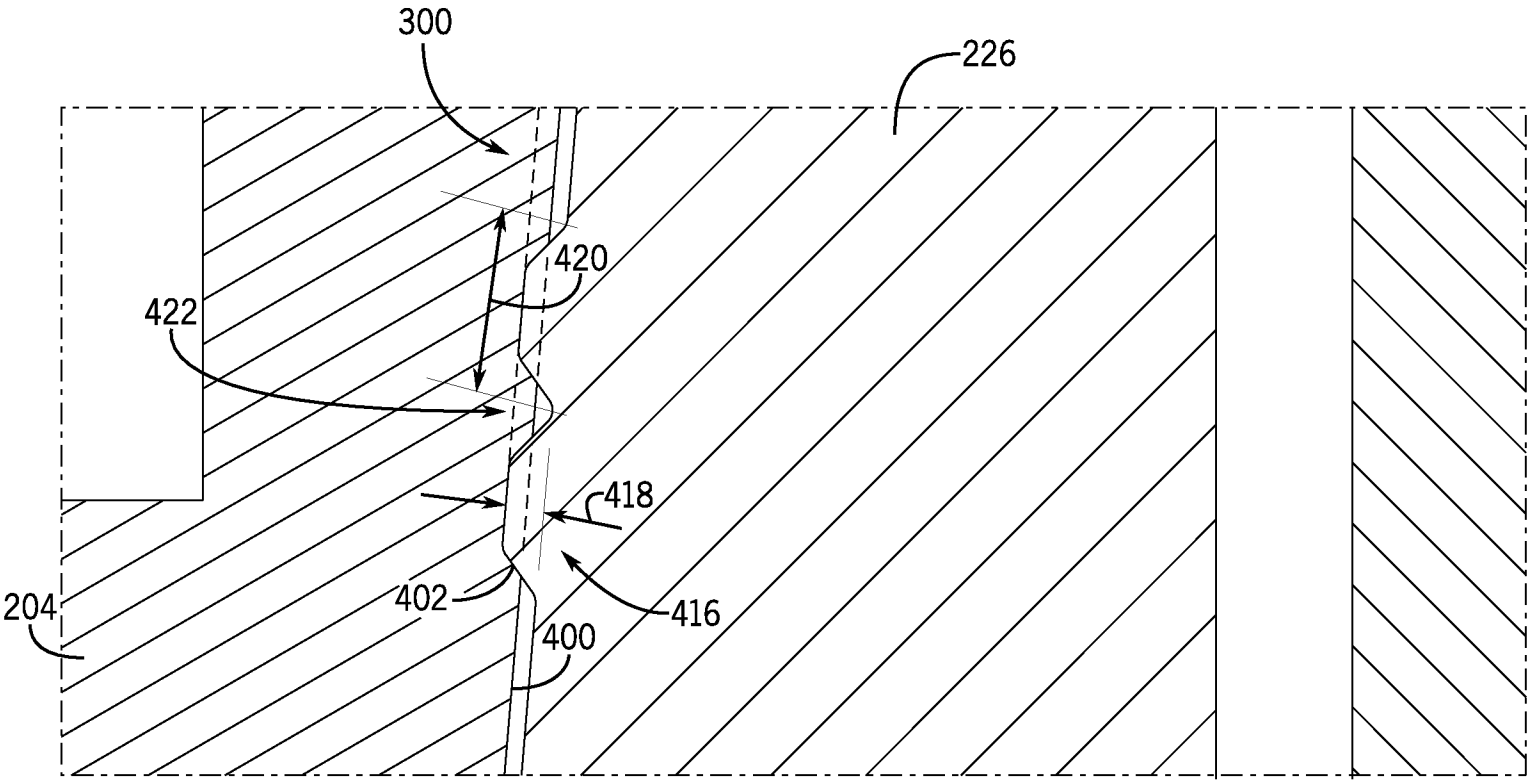
FIG. 4B is a cross-sectional side view of an embodiment of a first seal interface, in accordance with embodiments of the present disclosure.

FIG. 4A is a schematic cross-sectional view of a portion of the sealing assembly 218 in which the first seal interface 300, the second seal interface 302, and the third seal interface 304 as shown. In this example, each of the interfaces 300, 302, 304 are metal-to-metal seals. That is, prepared metallic surfaces are driven together such that a crunch or crush force causes one or more of the surfaces to mechanically deform, thereby forming a pressure barrier. In this example, the first seal interface 300 is formed between the seal ring 226 and the upper head 204. Mating tapered surfaces 400, 402 may, at least in part, cause the metal to metal seal. For example, a tapered surface 400 of the upper head 204 may engage the mating tapered surface 402 of the seal ring 226 as the fastener 212 (not pictured) drives the upper head 204 toward the lower head 206 at the coupling interface 216. The axial force of the fasteners 212 along the tapered surface 400, 402 may cause a crush or deformation of one or more surfaces, for example at sealing features (FIG. 4B). As a result, the metal-to-metal seal at the first seal interface 300 may be formed. It should be appreciated that the angles of the respective tapered surfaces 400, 402 may be particularly selected based, at least in part, on expected operating conditions, component dimensions, and the like. That is, the angles may vary or be different based on different operating conditions.

Further illustrated is the second seal interface 302 between the seal ring 226 and the packoff 222. In at least one embodiment, the second seal interface 302 is formed when a force is applied to the packoff 222 via the lock screws 232. That is, the second seal interface 302 may be formed at the well site after the packoff 222 is landed within the bore 220. In this example, the seal ring 226 includes a tapered surface 404 that interacts with a mating tapered surface 406 of the packoff 222. As noted above, angles of the respective tapered surface 404, 406 may be particularly selected based, at least in part, on expected operating conditions, component dimensions, and the like. That is, the angles may vary or be different based on different operating conditions. In this example, a wiper 408 is positioned between the seal ring 226 and the packoff 22 to clean the seal surface. Furthermore, the second seal interface 302 may extend across or beyond the wiper 408, such that both an upper and lower position relative to the wiper 408 includes the metal-to-metal seal. In at least one embodiment, the wiper 408 may be replaced with one or more seals. Additionally, the wiper 408 may be used with one or more seals in order to provide additional sealing redundancy.

FIG. 4A also includes the third seal interface 304 between the packoff 222 and the hanger 224. In at least one embodiment, the third seal interface 304 is formed when a force is applied to the packoff 222 via the lock screws 232. That is, the third seal interface 304 may be formed at the well site after the packoff 222 is landed within the bore 220. In this example, the packoff 222 includes a tapered surface 410 that interacts with a mating tapered surface 412 of the hanger 224. As noted above, angles of the respective tapered surface 410, 412 may be particularly selected based, at least in part, on expected operating conditions, component dimensions, and the like. That is, the angles may vary or be different based on different operating conditions. In this example, a wiper 414 is also present between the hanger 224 and the packoff 222. Furthermore, the third seal interface 304 may extend across or beyond the wiper 414, such that an both an upper and lower position relative to the wiper 414 includes the metal-to-metal seal. In at least one embodiment, the wiper 414 may be replaced with one or more seals. Additionally, the wiper 414 may be used with one or more seals in order to provide additional sealing redundancy.

As shown, various embodiments permit a plurality of metal-to-metal seals that are formed, at least in part, due to an external mechanical force applied to one or more components of the multi-bowl system. These seals may be activated separately or at substantially the same time. For example, in one configuration, the first seal interface 300 is formed prior to arrival at the well site and therefore may be considered as being formed separate from the seal interfaces 302, 304. However, it should be appreciated that additional sealing forces may also be applied at the well site. While the seal interface 300 may also be set, the additional forces may still be applied and may provide additional sealing capabilities. The seal interfaces 302, 304 may then be formed at substantially the same time due to the application of force via the lock screws 232.

FIG. 4B is a schematic cross-sectional view of an embodiment of the first seal interface 300 in which the tapered surfaces 400, 402 are brought together via application of an external force applied by the fasteners 212. In this example, the tapered surface 402 of the seal ring 226 includes sealing features 416 shown in the form of bumps. The illustrated features 416 extend away from the surface 402 having a height 418, thickness 420, and spacing 422. While only two features 416 are shown, it should be appreciated that there may be more or fewer features based. Additionally, shapes of the features 416 may vary. For example, the height 418, thickness 420, and spacing 422 may be particularly selected based on operating conditions. Additionally, the general cross-sectional appearance of the features 416 may also be adjusted. For example, the planar top shown in FIG. 4B is by way of example and is not intended to be limiting. Additionally, the sloped surfaces are also by example. The features 416 may be arcuate, pointed, or any other reasonable geometric shape. Furthermore, each of the features 416 may not be the same and may have different dimensions, shapes, or the like. In operation, the features 416 may catch upon application of the force from the fasteners 212, which may facilitate in the crush between the seal ring 226 and the upper head 204, thereby forming the first seal interface 300 as a metal-to-metal seal.

Figure 4C:
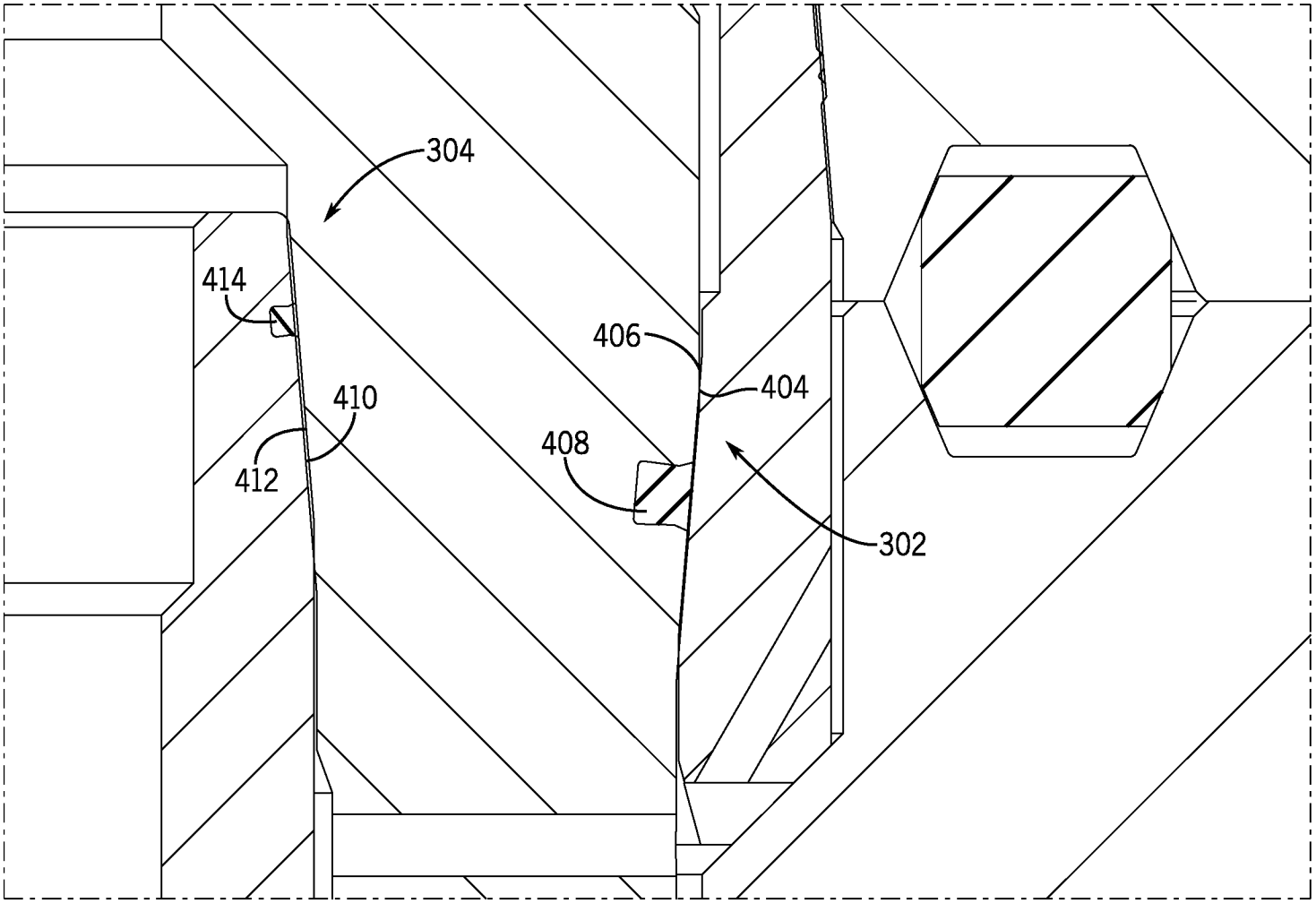
FIG. 4C is a cross-sectional side view of an embodiment of a second seal interface and a third seal interface, in accordance with embodiments of the present disclosure.

FIG. 4C is a schematic cross-sectional view of an embodiment of the second seal interface 302 and the third seal interface 304 in which the tapered surfaces 404, 406 and 410, 412 are brought together via application of an external force applied by the lock screws 232. In this example, the second seal interface 302 is shown radially outward from the third seal interface 304. As noted above, the tapered surface 404, 406 as shown having respective angels that facilitate the crush force or contact between the seal ring 226 and packoff 222 responsive to downward movement of the packoff 222. In this example, the wiper 408 is shown along the second seal interface 302, where a sealing surface may be cleaned or otherwise wiped clear prior to sealing engagement between the packoff 222 and the seal ring 226. As previous indicated, various dimensions such as a sealing surface length, along with the tapered angles, may be particularly selected based on one or more expected operating conditions.

The embodiment further illustrates the third sealing surface 304 between the hanger 224 and the packoff 222. As shown, the tapered surface 410, 412 are engaged to form a metal-to-metal seal, with the angles of the surfaces 410, 412 being particularly selected based, at least in part, on expected operating conditions. As previously indicated, the downward movement of the packoff 222 may be transmitted to the hanger to form a metal-to-metal seal between the components.

Figure 5:
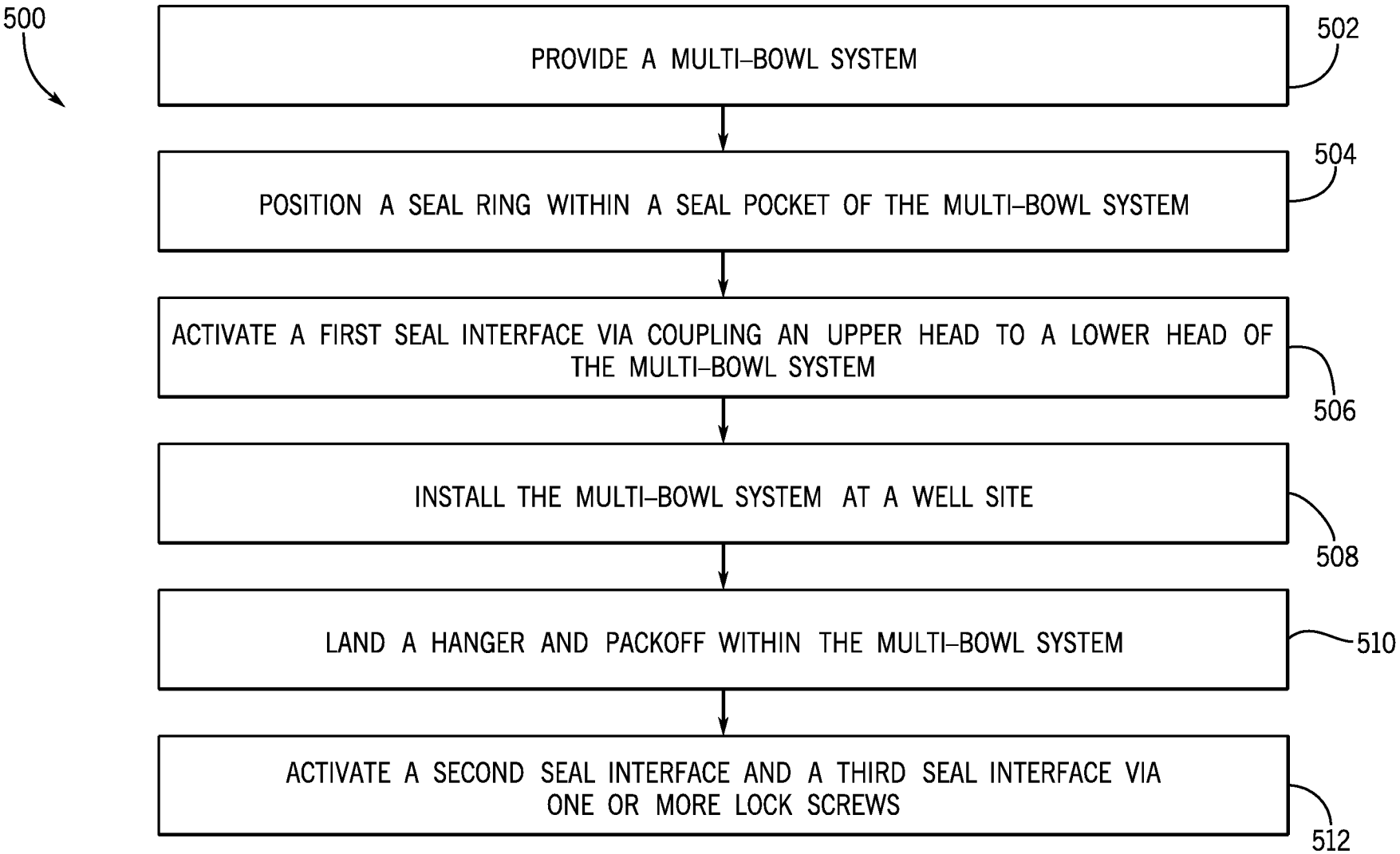
FIG. 5 is a flow chart of an embodiment of a process for forming one or more seals in a wellhead system, in accordance with embodiments of the present disclosure.

FIG. 5 is a flow chart of an embodiment of a process 500 for setting one or more seals within a sealing assembly. It should be appreciated that for this process, and all processes described herein, that there may be more or fewer steps. Additionally, the steps may be performed in a different order, or in parallel, unless otherwise specifically stated. In this example, a multi-bowl system is provided 502, where the multi-bowl system includes an upper head and a lower head. A seal ring is arranged within a seal pocket of the multi-bowl system 504. For example, the seal pocket may be positioned to extend between the upper head and the lower head. A first seal interface may be activated by securing the upper head to the lower head 506. For example, fasteners may axially drive the upper head and lower head together, which may drive a sealing surface of the seal ring into the upper head and/or the lower head, thereby forming a metal-to-metal seal. The multi-bowl system may then be tested or otherwise prepared for delivery and use at a well site.

The multi-bowl system may be installed at a well site 508. For example, the multi-bowl system may be used with one or more additional completion or recovery systems, such as a wellhead assembly or the like. A hanger and packoff may then be landed within the multi-bowl system 510. For example, a tool may deliver the hanger and packoff, which may be coupled together, into a bore of the multi-bowl system 510. Second and third seal interfaces may then be activated 512. For example, lock screws may extend through the lower head and engage the packoff, which may drive the packoff in a downward direction, thereby causing interaction between different sloped surfaces of the seal ring 226, the hanger 224, and the packoff 222 in order to form metal-to-metal seals between the various components.

The foregoing disclosure and description of the disclosed embodiments is illustrative and explanatory of various embodiments of the present disclosure. Various changes in the details of the illustrated embodiments can be made within the scope of the appended claims without departing from the true spirit of the disclosure. The embodiments of the present disclosure should only be limited by the following claims and their legal equivalents.

The invention claimed is:

1. A wellbore system, comprising:

an upper head;

a lower head coupled to the upper head by one or more fasteners, the one or more fasteners arranged axially along a bore extending through the upper head and the lower head;

a seal ring positioned within a seal pocket formed in the upper head and the lower head, the seal ring positioned to engage the upper head to form a first seal interface between the upper head and the seal ring;

a hanger arranged within the bore;

a packoff positioned between the hanger and the lower head; and one or more lock screws to extend through the lower head and engage the packoff, the one or more lock screws to apply a downward force to the packoff to establish a second seal interface between the packoff and the seal ring and a third seal interface between the packoff and the hanger, wherein the first seal interface, the second seal interface, and the third seal interface are all metal-to-metal seals.

2. The wellbore system of claim 1, wherein the first seal interface comprises:

a first tapered surface of the upper head; and a second tapered surface of the seal ring, wherein an axial force applied by the one or more fasteners is configured to drive the first tapered surface into the second tapered surface.

3. The wellbore system of claim 1, wherein the second seal interface comprises:

a first tapered surface of the seal ring; and a second tapered surface of the packoff, wherein a radial force applied by the one or more lock screws is configured to drive the packoff in a downward direction to cause the first tapered surface to interact with the second tapered surface to deform one or more of the first tapered surface or the second tapered surface.

4. The wellbore system of claim 1, wherein the third seal interface comprises:

a first tapered surface of the packoff; and a second tapered surface of the hanger, wherein a radial force applied by the one or more lock screws is configured to drive the packoff in a downward direction to cause the first tapered surface to interact with the second tapered surface to deform one or more of the first tapered surface or the second tapered surface.

5. The wellbore system of claim 1, further comprising:

a wiper arranged along the second seal interface.

6. The wellbore system of claim 1, wherein the packoff is positioned to extend across a coupling interface between the upper head and the lower head.

7. The wellbore system of claim 1, wherein the first seal interface comprises:

a sealing feature positioned along a tapered surface of the seal ring, the sealing feature extending away from the tapered surface.

8. The wellbore system of claim 1, wherein the second seal interface is set at approximately a same time as the third seal interface.

9. A sealing assembly, comprising:

a seal ring to be positioned within a seal pocket of a wellhead system;

a packoff to be positioned within a first bore of the wellhead system, the packoff to be radially inward of the seal ring; and a hanger to be positioned within a second bore of the packoff, the hanger to be radially inward of the packoff;

wherein the packoff is configured to move in a downward direction responsive to an external mechanical force to form a first metal-to-metal seal between the seal ring and the packoff and to form a second metal-to-metal seal between the packoff and the hanger.

10. The sealing assembly of claim 9, where the packoff further comprises:

a tapered receptacle positioned to receive the external mechanical force, the external mechanical force to be applied in a radial direction, wherein an angle of the tapered receptacle converts at least a portion of the external mechanical force into a downward force.

11. The sealing assembly of claim 10, wherein the tapered receptacle is a continuous tapered receptacle about a circumference of the packoff.

12. The sealing assembly of claim 9, further comprising:

a wiper along an interface surface of the packoff.

13. The sealing assembly of claim 9, further comprising:

a hanger seal along an interface surface of the hanger.

14. The sealing assembly of claim 9, further comprising:

engagement features formed along the packoff, the engagement features to couple to a tool to position the packoff within the first bore.

15. The sealing assembly of claim 9, wherein the first metal-to-metal seal and the second metal-to-metal seal are both formed at substantially a same time.

16. A method, comprising:

providing a wellhead assembly including a seal ring, wherein a first seal interface with a metal-to-metal seal is formed between the seal ring and a component of the wellhead assembly;

installing the wellhead assembly at a well site;

landing a hanger and a packoff within a bore of the wellhead assembly; and activating one or more lock screws to engage the packoff to cause a second seal interface with a metal-to-metal seal to form between the seal ring and the packoff and to cause a third seal interface with a metal-to-metal seal to form between the packoff and the hanger.

17. The method of claim 16, wherein the one or more lock screws drive the packoff in a downward direction.

18. The method of claim 16, wherein the component is an upper head of multi-bowl system, the method further comprising:

providing a lower head of the multi-bowl system;

positioning the seal ring within a seal pocket; and coupling the upper head to the lower head.

* * * * *